US007475814B2

(12) United States Patent
Wingo et al.

(10) Patent No.: US 7,475,814 B2
(45) Date of Patent: Jan. 13, 2009

(54) TAG MOUNTING DEVICE USED FOR LOCATING SHIPPING CONTAINERS AND TRUCK TRAILERS

(75) Inventors: Brett A. Wingo, San Jose, CA (US); Walter S. Johnson, San Jose, CA (US); Richard W. Benner, San Martin, CA (US)

(73) Assignee: Wherenet Corp., Santa Clara, CA (US)

( * ) Notice: Subject to any disclaimer, the term of this patent is extended or adjusted under 35 U.S.C. 154(b) by 460 days.

(21) Appl. No.: 11/287,600

(22) Filed: Nov. 28, 2005

(65) Prior Publication Data

US 2007/0119927 A1 May 31, 2007

(51) Int. Cl.

| | |
|---|---|
| ***G07B 15/02*** | (2006.01) |
| ***G06F 19/00*** | (2006.01) |
| ***G08B 13/14*** | (2006.01) |
| ***G08B 1/08*** | (2006.01) |
| ***H04Q 7/00*** | (2006.01) |

(52) U.S. Cl. ..... 235/384; 235/385; 340/539.1; 340/572.8

(58) Field of Classification Search ..... 235/385, 235/381, 384; 340/539.1, 539.13, 539.18
See application file for complete search history.

(56) References Cited

U.S. PATENT DOCUMENTS

| | | | | |
|---|---|---|---|---|
| 4,506,798 A | | 3/1985 | Goutille | 220/1.5 |
| 5,172,121 A | * | 12/1992 | Beecher | 342/51 |
| 5,656,996 A | * | 8/1997 | Houser | 340/541 |
| 5,920,287 A | * | 7/1999 | Belcher et al. | 342/450 |
| 6,026,378 A | | 2/2000 | Onozaki | 705/28 |
| 6,121,926 A | | 9/2000 | Belcher et al. | 342/450 |
| 6,127,938 A | * | 10/2000 | Friedman | 340/693.6 |
| 6,127,976 A | | 10/2000 | Boyd et al. | 342/463 |
| 6,317,082 B1 | | 11/2001 | Bacon et al. | 342/465 |
| 6,356,802 B1 | | 3/2002 | Takehara et al. | 700/215 |
| 6,370,222 B1 | | 4/2002 | Cornick, Jr. | 378/57 |
| 6,380,894 B1 | | 4/2002 | Boyd et al. | 342/450 |
| 6,434,194 B1 | | 8/2002 | Eisenberg et al. | 375/238 |
| 6,502,005 B1 | | 12/2002 | Wrubel et al. | 700/116 |
| 6,535,116 B1 | * | 3/2003 | Zhou | 340/447 |
| 6,577,921 B1 | | 6/2003 | Carson | 700/214 |

(Continued)

FOREIGN PATENT DOCUMENTS

| | | |
|---|---|---|
| DE | 42 15 236 | 11/1993 |

(Continued)

*Primary Examiner*—Le M. Thien
*Assistant Examiner*—Thien T Mai
(74) *Attorney, Agent, or Firm*—Alston & Bird LLP

(57) ABSTRACT

A tag mounting device can temporarily mount a tag transmitter on a shipping container or trailer for tracking location of the shipping container or trailer. The tag mounting device includes a mounting frame having a support leg with opposing ends. A clamp mechanism is carried by the support leg for clamping the support leg onto a rim of a container or trailer such that the support leg extends against a surface of the container or trailer. A tag support member extends outward from the support leg. A tag transmitter is carried by the tag support member and operative for transmitting wireless signals to at least one receiver for subsequent processing to determine the location of the tag transmitter and a container or trailer on which the tag mounting device is mounted.

20 Claims, 9 Drawing Sheets

U.S. PATENT DOCUMENTS

| | | | | |
|---|---|---|---|---|
| 6,593,885 | B2 | 7/2003 | Wisherd et al. | 342/463 |
| 6,655,582 | B2 | 12/2003 | Wohl et al. | 235/380 |
| 6,657,586 | B2 | 12/2003 | Turner | 342/357.07 |
| 6,665,582 | B1 | 12/2003 | Moritz et al. | 700/213 |
| 6,665,585 | B2 | 12/2003 | Kawase | 700/226 |
| 6,812,839 | B1 | 11/2004 | Belcher et al. | 340/572.1 |
| 6,853,687 | B2 | 2/2005 | Harrington et al. | 375/259 |
| 6,853,875 | B1 | 2/2005 | Moritz et al. | 700/229 |
| 6,859,485 | B2 | 2/2005 | Belcher | 375/130 |
| 6,892,054 | B2 | 5/2005 | Belcher et al. | 455/63.1 |
| 6,927,688 | B2 | 8/2005 | Tice | 340/539.26 |
| 6,975,224 | B2 * | 12/2005 | Galley et al. | 340/539.18 |
| 2002/0070891 | A1 | 6/2002 | Huston et al. | 342/357.09 |
| 2002/0181565 | A1 | 12/2002 | Boyd et al. | 375/152 |
| 2003/0137968 | A1 | 7/2003 | Lareau et al. | 370/349 |
| 2003/0191555 | A1 | 10/2003 | Takehara et al. | 700/215 |
| 2004/0066328 | A1 | 4/2004 | Galley, III et al. | 342/357.7 |
| 2004/0183673 | A1 * | 9/2004 | Nageli | 340/539.13 |
| 2004/0249557 | A1 | 12/2004 | Harrington et al. | 701/115 |
| 2004/0263329 | A1 * | 12/2004 | Cargonja et al. | 340/539.22 |
| 2005/0099305 | A1 * | 5/2005 | Maloney | 340/572.8 |
| 2006/0006228 | A1 * | 1/2006 | Poulter | 235/385 |
| 2006/0087431 | A1 * | 4/2006 | Shieh et a. | 340/572.1 |
| 2006/0255950 | A1 * | 11/2006 | Roeder et al. | 340/572.7 |
| 2007/0008107 | A1 * | 1/2007 | Farrell et al. | 340/539.1 |

FOREIGN PATENT DOCUMENTS

| | | |
|---|---|---|
| EP | 1 544 386 | 6/2005 |

* cited by examiner

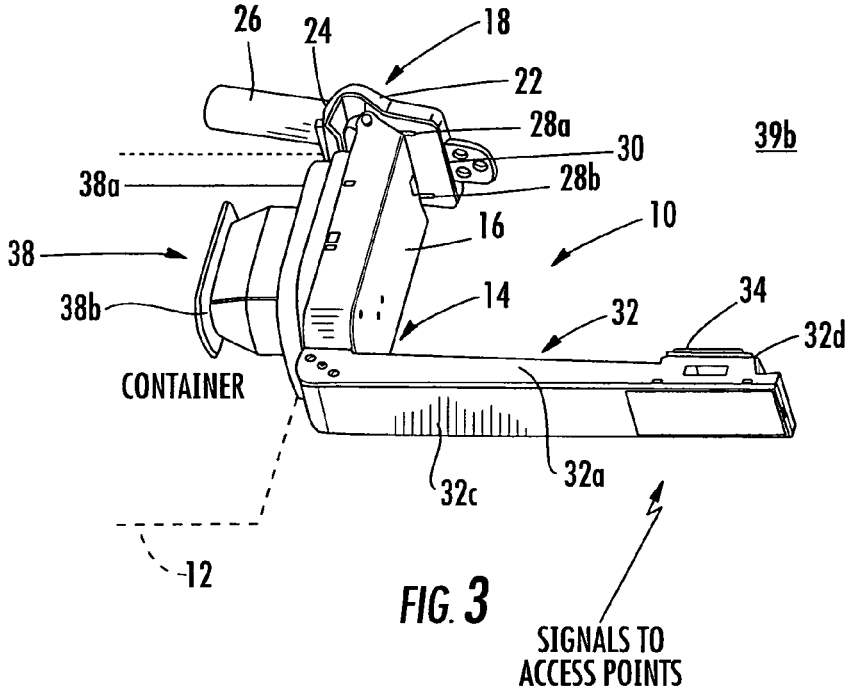
FIG. 3
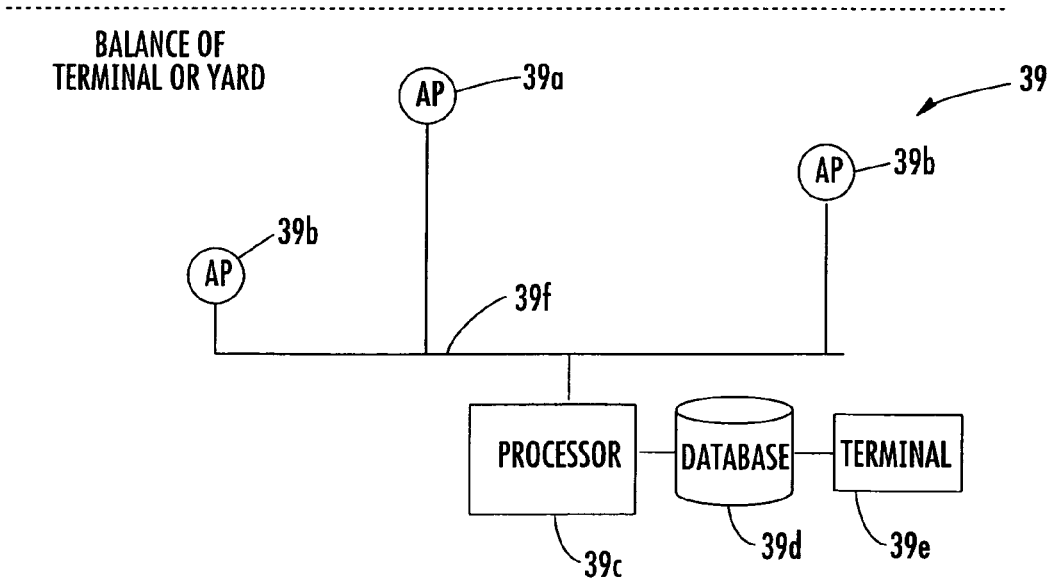

TAG MOUNTING DEVICE USED FOR LOCATING SHIPPING CONTAINERS AND TRUCK TRAILERS

FIELD OF THE INVENTION

This invention relates to real-time location systems (RTLS), and more particularly, this invention relates to real-time location systems for tracking shipping containers and truck trailers.

BACKGROUND OF THE INVENTION

Many container storage yards and shipping terminals, for example, a modern marine terminal, must efficiently process an increasing number of shipping containers or truck trailers in an area of limited space with little, if any, land available for expansion. Capacity demands are increasing rapidly with higher volumes of container traffic both domestic and worldwide, and in marine terminals, for example, new, larger container ships are coming on-line. Specific shipping containers and truck trailers should be located on demand within any terminal among the thousands of shipping containers and dozens or hundreds of truck trailers within a yard or terminal at any given time. This can be difficult if there is a lack of any accurate and real-time identification of containers or trailers and a tracking system for the containers or truck trailers. Often, the trailers or containers require a temporary identification and not a permanent identification, such as when a trailer is temporarily passing through a yard or terminal, or a shipping container is in one location for a short period of time until it enters long term transit. Some location systems are directed to using a permanent tag transmitter that emits a radio frequency beacon signal to a plurality of access points, which then processes the signals for geolocating the tag transmitter. It would be advantageous, however, if some type of temporary tag mounting device could provide for temporary identification of a trailer or container, allowing the tag transmitter to be applied to a shipping container or truck trailer using this mounting device, then removed and reapplied to another shipping container or truck trailer at a later date, e.g., the next hour, day or week, after the first shipping container or truck trailer no longer requires the temporary identification and tag transmitter.

SUMMARY OF THE INVENTION

In accordance with one non-limiting embodiment of the present invention, a system allows temporary tracking of a shipping container or a trailer within a monitored environment, and in one aspect, includes a tag mounting device that is adapted to be temporarily mounted to a container or trailer within the monitored environment. The tag mounting device can be formed as a mounting frame having a support leg with opposing ends. A clamp mechanism is carried by the support leg and clamps the support leg onto a rim of the container or trailer such that the support leg extends against the surface of the container or trailer. A tag support member extends outward from the end of the support leg opposed to the clamping member. A tag transmitter is carried by the tag support member and operative for transmitting wireless signals, such as radio frequency (RF), magnetic, or similar wireless signals. At least one receiver is positioned at a known location within the monitored environment and receives the wireless signals from the tag transmitter. A processor is operatively connected to the receiver for locating the tag transmitter and determining the location of the container or trailer such as by geolocation techniques.

In yet another aspect, the mounting frame is substantially L-shaped and the tag support member extends transverse from the support leg. The clamping member can be formed as a latch member pivotally connected to the end of the support leg. A tongue member as part of the latch member extends into the rim on the container or trailer. A lever is carried by the latch member and pivotally moves the latch member, allowing the latch member to engage the rim on the container or trailer and temporarily mounting the tag mounting device onto a container or trailer. The latch member can be formed as a biasing member for biasing the support leg against the surface of the container or trailer when the latch member engages the rim of the container or trailer.

A container insert can be removably mounted on the support leg and sized to be inserted into a cavity on a container and secure the tag mounting device on the container, with the support leg engaging a surface of the container. This container insert can be sized to space the clamp mechanism from a surface of the container such that the container insert supports the tag mounting device on the container. The container insert can taper from the support leg outward to facilitate insertion of the container insert within a cavity of the container.

In yet another aspect, the location processor can be operative for correlating a wireless signal as a first-to-arrive signal and conducting differentiation of first-to-arrive signals for locating the tag transmitter. The wireless signals can be formed as spread spectrum wireless RF signals.

A method aspect is also disclosed.

BRIEF DESCRIPTION OF THE DRAWINGS

Other objects, features and advantages of the present invention will become apparent from the detailed description of the invention which follows, when considered in light of the accompanying drawings in which:

FIG. 3 is a perspective view of the tag mounting device having an additional container insert adapted to be inserted within a frame opening or other cavity of a shipping container and showing a radio location and tracking system as part of a terminal or container yard that receives wireless signals from the tag transmitter.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

The system and method as described in accordance with one non-limiting example of the present invention uses a real-time location system for real-time container and trailer tracking. It is especially adapted for use in storage yards and terminals, which have stacks of grounded containers and trailers. The system and method uses low-power wireless transmissions to determine the location of radio emission beacons, called tags or tag transmitters, which are temporarily mounted by a tag mounting device to a trailer pulling a container on a chassis or a shipping container.

Figure 1:
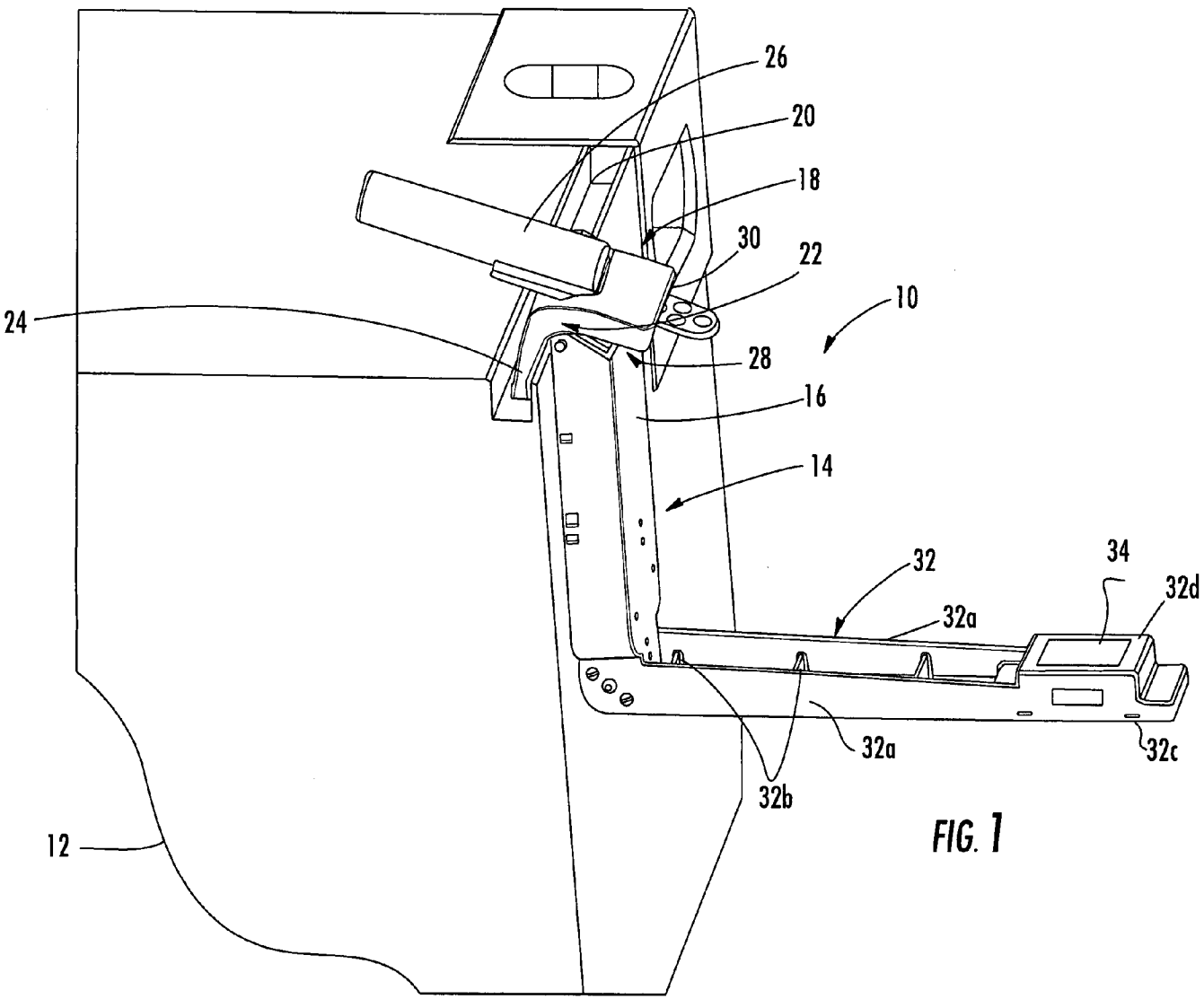
FIG. 1 is a perspective view of the tag mounting device attached by its clamp mechanism onto the rim of a truck trailer or shipping container.

As shown in FIG. 1, a tag mounting device illustrated generally at 10 is temporarily mounted to a container or trailer 12 within a monitored environment. This tag mounting device 10 includes a mounting frame 14 that is substantially L-shaped in configuration. It includes a support leg 16 having opposing ends such that the support leg extends against the surface of the container or trailer 12 when the tag mounting device is mounted thereto. A clamp mechanism 18 is carried at one end (an upper end as illustrated) of the support leg 16 and clamps the support leg onto a rim 20 of the container or trailer such that the support leg extends against the surface of the container or trailer as illustrated. This clamp mechanism 18 can be formed as a latch member 22 pivotally connected to the one end of the support leg. The latch member 22 can include a tongue member 24 as illustrated that extends into the rim 20 on the container or trailer 12. A lever 26 formed as a pole is carried by the latch member 22 and is actuated by a user to pivot the latch member and allow the latch member to engage the rim on the container or trailer by having its tongue member 24 inserted into the rim that is formed in this non-limiting example as a groove on the container or trailer. The tag mounting device 10 is, thus, temporarily mounted onto a container or trailer 12. A biasing member 28 can be engaged between the clamp mechanism 18 and upper end of the support leg 16 for biasing together the support leg and tongue member 24 engaged in the rim such that the support leg 16 is biased against the surface of the container or trailer.

In one non-limiting embodiment, the clamp mechanism 18 is formed as a single or integrally formed spring member bent about 90 degrees to form the latch member 22. One 90 degree bend includes a slot 30 for receiving a flattened end of the lever 26 and the other 90 degree bend forms the tongue member 24 that extends into the rim 20 on the container or trailer. A tag support member 32 extends outward from the other end of the support leg 16, corresponding to the lower end when the tag mounting device 10 is temporarily mounted to a container or trailer. The tag support member 32 extends outward and a tag transmitter 34 is carried by the tag support member 32 at its end as opposed to the end connected to the support leg. The tag transmitter as noted before is operative for transmitting wireless signals, such as radio frequency (RF), magnetic or other signals.

Figure 2:
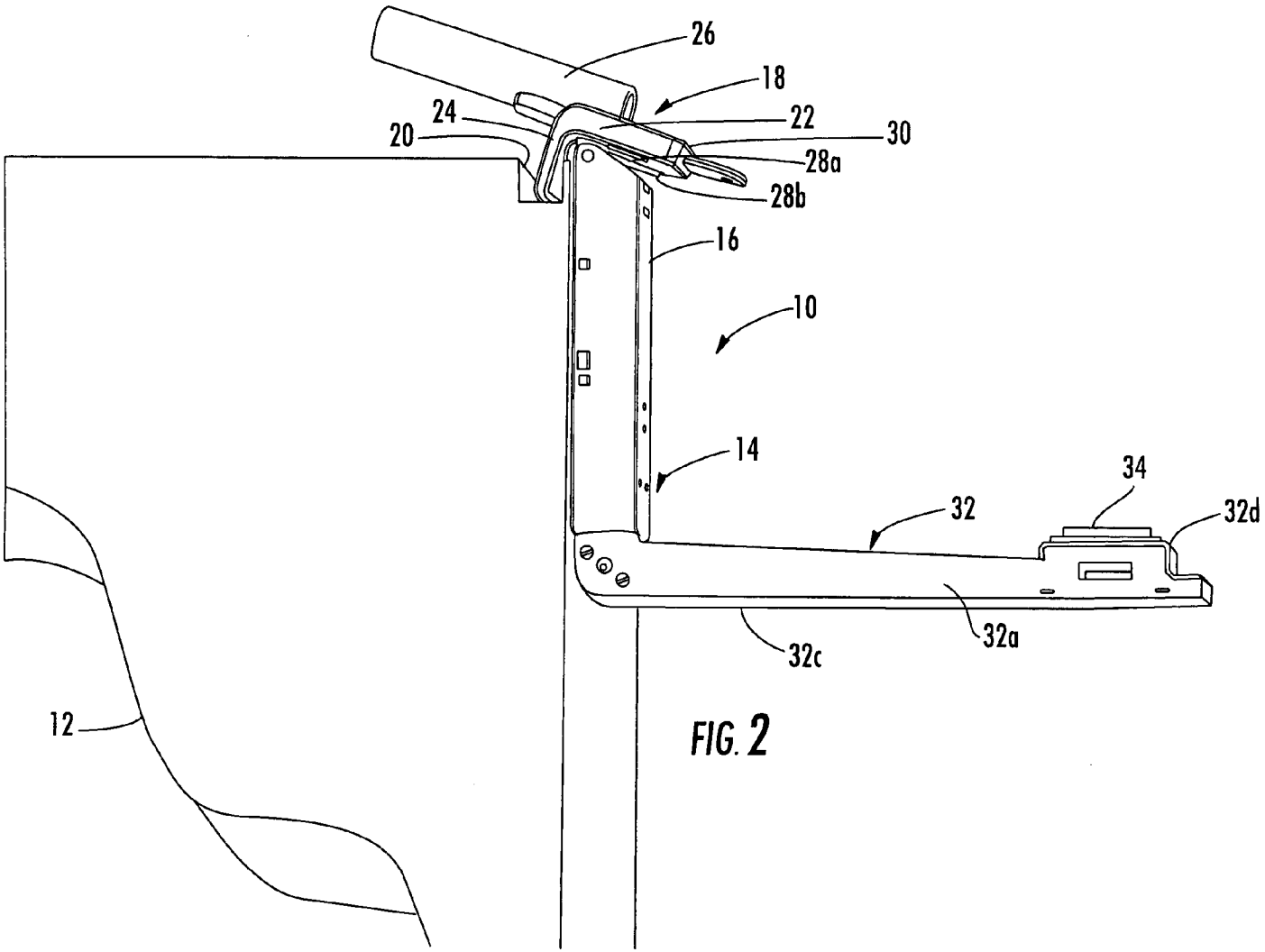
FIG. 2 is a side elevation view of the tag mounting device shown in FIG. 1 as attached to the rim.

As shown in FIGS. 1 and 2, the tag mounting device 10 can be constructed from thin plate or sheet materials, such as formed from a metallic material, including lightweight aluminum. It could also be formed from rigid plastic. The support leg 16 can be rectangular configured in cross section to add strength to the support leg. The tag support member 32 can be formed by two opposing plates or sheets 32*a* with support ribs 32*b* extending therebetween and a bottom support surface 32*c* as shown in FIG. 3. It is possible that the tag support member 32 could be pivotally mounted to the support leg 16 to allow the tag support member to pivot upward and rest against the support leg for storage. In other embodiments, the tag support member 32 could be fixed to the support leg 16. The end of the tag support member 32 extending from the support leg includes a flat support surface 32*d* on which the tag transmitter 34 is mounted.

FIG. 3 shows at the underside of the clamp mechanism 18 the biasing member 28 such as formed as a spring member for biasing the support leg 16 against the surface of the container or trailer when the tongue member engages into the rim of the container or trailer. FIG. 2 shows the biasing member 28 as two spring members 28*a*, 28*b* extending along the underside of the clamp mechanism.

Figure 4:
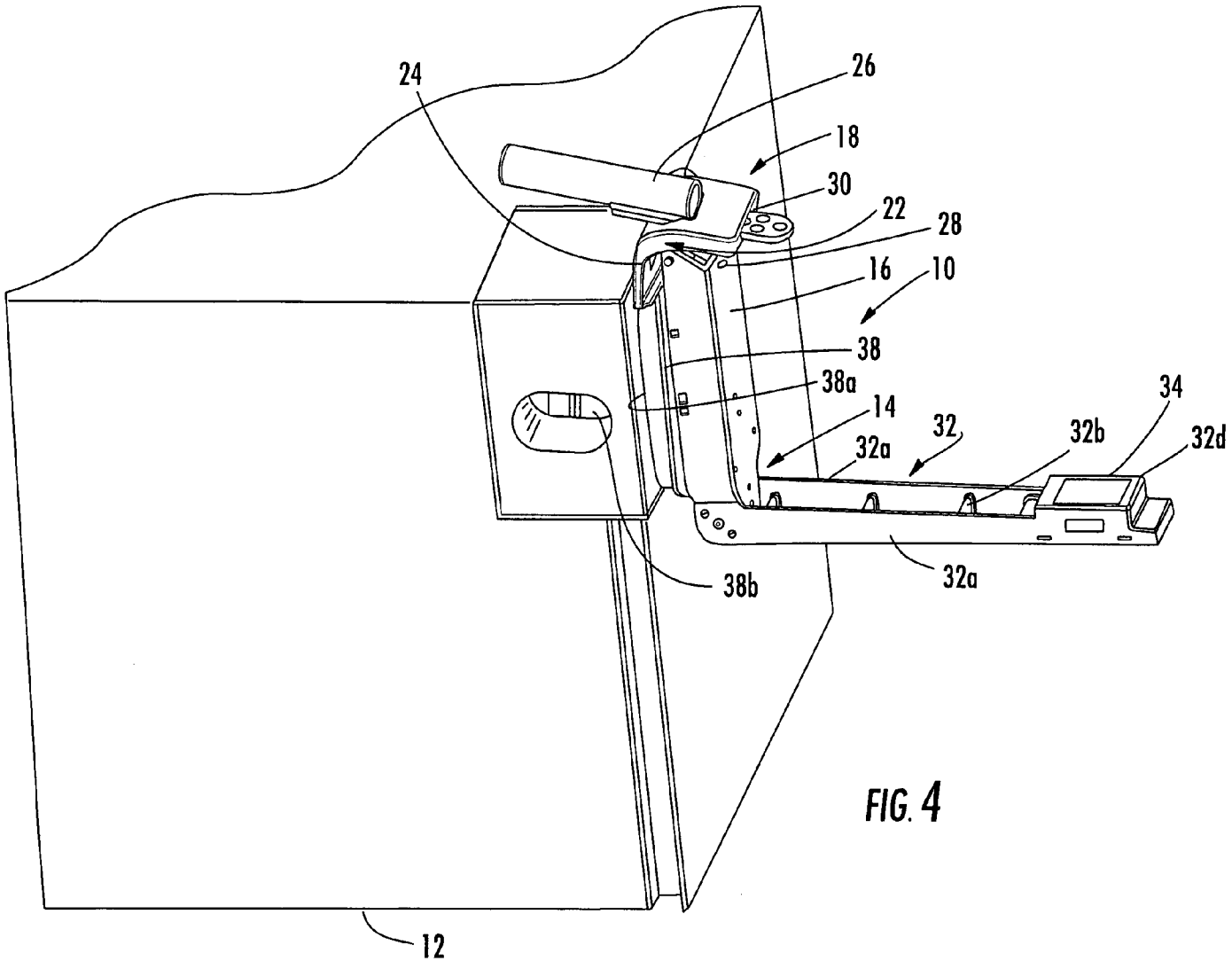
FIG. 4 is another perspective view of the tag mounting device and container insert shown in FIG. 3.

In some designs for a shipping (or cargo) container 12, a rim 20 is not easily accessible for mounting the tag mounting device using the clamp mechanism 18 and tongue member 24, and therefore, a container insert 38 as shown in FIGS. 2 and 3 is mounted on the support leg 16 on a side that would engage the shipping container. This container insert 38 includes a planar mounting surface 38*a* that could include a tongue or other member that extends into a groove formed on the backside of the support leg 16 or other mounting mechanism to retain the container insert at the support leg. The container insert 38 is, therefore, removably mounted on the support leg and sized to be inserted into a cavity or opening on a container, such as shown in FIG. 4, thus securing the tag mounting device on the container. The support leg engages a surface of the container. This container insert 38 is sized to space the clamp mechanism from a surface of the container such that the container insert supports the tag mounting device on the container. The container insert 38 includes its mounting surface 38*a* engaged against the container and a tapered portion 38*b* inserted within the container opening. The tapered portion 38*b* also facilitates insertion of the container insert within a cavity or other opening of the container.

FIG. 3 also shows a basic radio location and tracking system 39 as part of a terminal or container yard that forms part of a monitored environment. As illustrated, at least one receiver and in one aspect, a plurality of spaced apart receivers also referred to as access points 39*a* are positioned at known locations within the monitored environment 39*b* and receive the wireless RF signals from the tag transmitter. The wireless signals could be radio frequency (RF), magnetic or other signals. The description in this illustrated embodiment, however, will proceed with a description of wireless RF signals. The monitored environment 39*b* could be a terminal or yard. A location processor 39*c* is operatively connected to the access points 39*a* and geolocates the tag transmitter 34 and determines the location of the shipping container or trailer. The location processor 39*c* is operative for correlating an RF signal as a first-to-arrive signal and conducting differentiation of first-to-arrive signals for locating the tag transmitter, and thus, the tag mounting device 10 attached to the shipping container or trailer 12. These RF signals can be formed as spread spectrum wireless RF signals as will be explained below. A database 39*d* can be connected to the location processor for storing identification and tag location history. A terminal 39*e*, for example, a personal computer, is connected to the database 39*d* and information about location tracking can be displayed.

A tag transmitter transmits radio signals to the receivers 39*a* in the surrounding environment. These are typically located at spaced-apart, different locations, and include receivers and sometimes transmitters. This receiver receives the wireless RF signals, including an ID of the tag, from the wireless tag transmitter contained in a tag. Each receiver is connected to the processor 39*c* or other server by a wireless or wired LAN 39*f*. The processor 39*c* determines location of each tag using technology similar to GPS.

A real-time location system and method that can be modified for use in the system and method of the present application is described in commonly assigned U.S. Pat. No. 6,657,586 and published patent application no. 2002/0181565, the disclosures which are hereby incorporated by reference in their entirety. Similar, commonly assigned patents include U.S. Pat. Nos. 5,920,287; 5,995,046; 6,121,926; and 6,127,976, the disclosures which are hereby incorporated by reference in their entirety.

As noted in the '586 patent, GPS can be used with a receiver 39*a* as a tag signal reader or locating access point for adding accuracy. Also, a port device (either separate or part of a locating access point) can include circuitry operative to generate a rotating magnetic or similar electromagnetic or other field such that the port device is operative as a proximity communication device that can trigger a tag transmitter to transmit an alternate (blink) pattern. The port device acts as an interrogator, and can be termed such. Such an interrogator is described in commonly assigned U.S. Pat. No. 6,812,839, the disclosure which is incorporated by reference in its entirety. When a tag transmitter passes through a port device field, the tag can initiate a preprogrammed and typically faster blink rate to allow more location points for tracking a tagged asset, such as a vehicle hauling a container as it passes through a critical threshold, for example, a shipping/receiving backdoor or gate entry to a yard or marine terminal. Such tags, port devices, and Access Points are commonly sold under the trade designation WhereTag, WherePort and WhereLan by Wherenet USA headquartered in Santa Clara, Calif.

The real-time location system 39 can provide one wireless infrastructure for locating a particular shipping container or truck trailer on which the tag mounting device is temporarily mounted. The real-time location system 39 provides real-time ID and location of tags, and provides reliable telemetry to record transactions, and provides mobile communications to work instruction and data entry terminals. Any terminal operating (management) software (TOS) can be optimized by real-time location and telemetry data to provide real-time, exact-slot accuracy of container ID and location, and real-time location and automatic telemetry of container transactions and container handling equipment and other mobile assets. The real-time location system is applicable for basic container storage as stacked containers (grounded) and parked containers on a chassis (wheeled) and tractor trailers.

As illustrated in FIG. 1, the circuitry of a respective tag 34 may be housed in a relatively compact, sealed transceiver module, which is sized to accommodate installation of a transceiver chip and one or more relatively long-life, flat-pack batteries and sensor devices. As a non-limiting example, the module may be rectangularly shaped, having a volume on the order of slightly more than one cubic inch, which allows the tag to be readily affixed to the temporary tag mounting device.

Figure 5A:
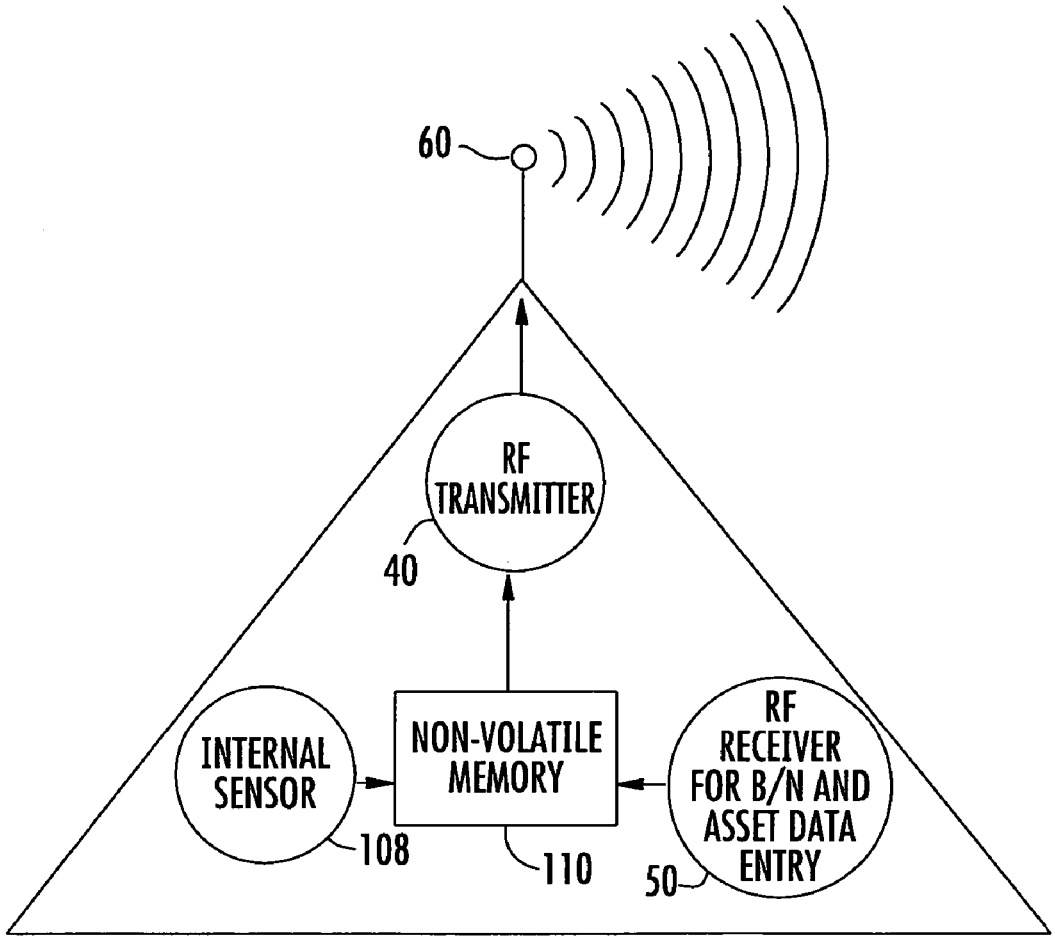
FIG. 5A is general functional diagram of a tag that can be used in the radio location and tracking systems shown in FIG. 3.
Figure 5B:
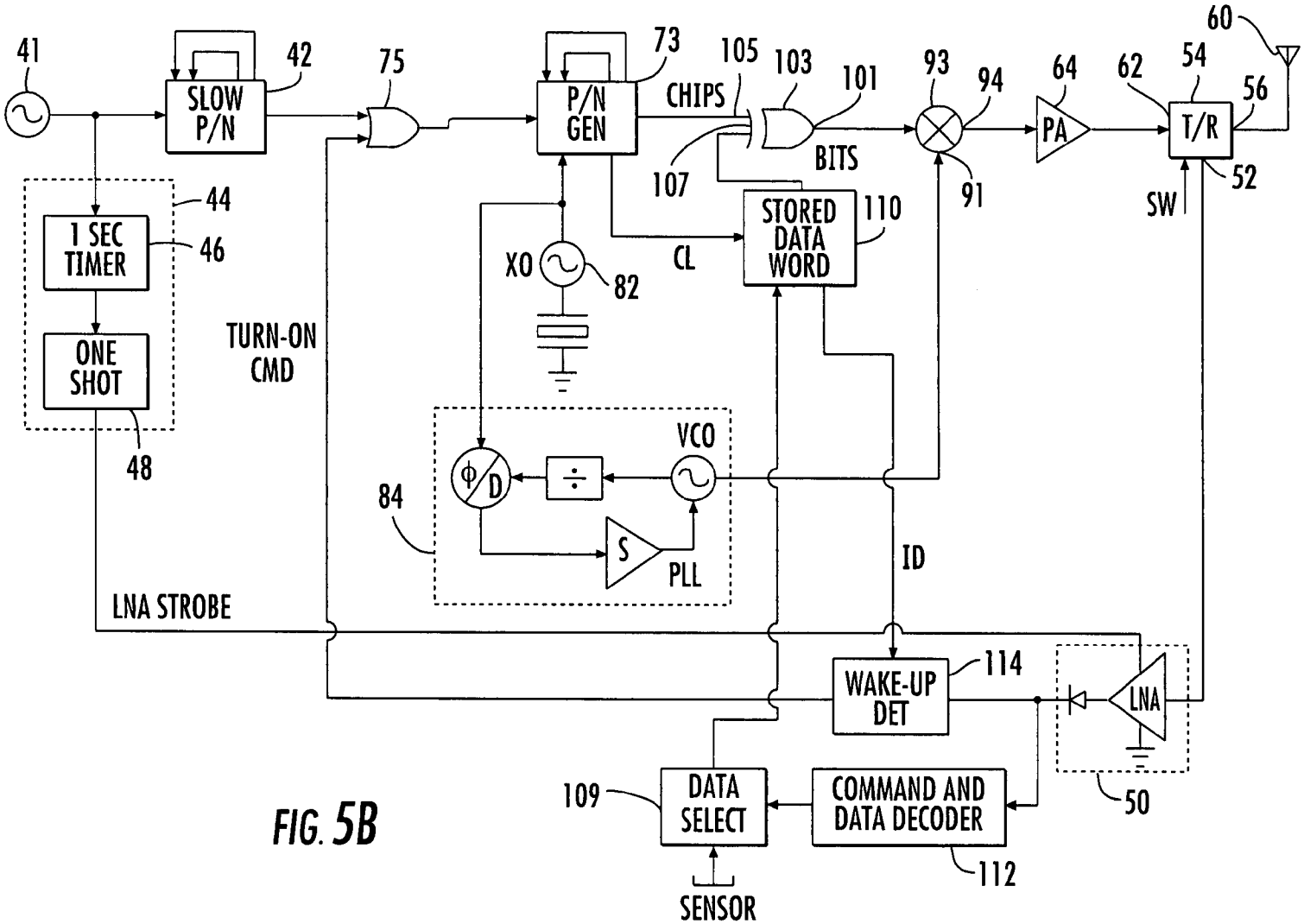
FIG. 5B is a schematic circuit diagram showing the circuit architecture of a radio frequency (RF) tag such as shown in FIG. 5A as a tag transceiver, which includes transmitter function in accordance with one non-limiting example of the present invention.

The general functional architecture of a tag formed as a transceiver (transmitter-transponder) unit employed in the radio location and tracking system 39 is diagrammatically illustrated in FIG. 5A and the circuit components thereof are shown in detail in FIG. 5B, such as disclosed in the incorporated by reference '926 patent. For sourcing signals to be transmitted by an RF transmitter section 40, the tag transceiver may comprise a relatively coarse oscillator 41, whose output is fed to a first "slow" pseudo random pulse generator 42 and to a strobe pulse generator 44. As a non-limiting example, oscillator 41 may be implemented by means of a relatively inexpensive RC oscillator, which is sensitive to environmental parameter (e.g., temperature) variations and thus further minimizes the likelihood that any two tags will transmit simultaneously.

The strobe generator 44 includes a timer 46 having a prescribed time-out duration (e.g., one-second) and a (one-shot) delay circuit 48, the output of which is a low energy (e.g., several microamps) receiver enable pulse having a prescribed duration (e.g., one-second wide). This pulse is used to controllably enable or strobe a relatively short range receiver 50, such as a crystal video detector, which requires a very insubstantial amount of power compared to other components of the tag. Because the receiver enable pulse is very low power, it does not effectively affect the tag's battery life.

The duration of the receiver enable pulse produced by the strobe pulse generator 42 is defined to ensure that any low power interrogation or query signal generated by a transceiver, such as a battery-powered, portable interrogation unit, to be described, will be detected by the crystal video receiver 50. As a relatively non-complex, low power device, crystal video receiver 50 is responsive to queries only when the interrogating unit is relatively close to the tag (e.g., on the order of ten to fifteen feet). This prevents an interrogator wand (to be described) from stimulating responses from a large number of tags. Signal strength measurement circuitry within the interrogator wand may be used to provide an indication of the proximity of the queried tag relative to the location of the wand.

In order to receive interrogation signals from the interrogating unit, the receiver 50 has its input coupled to a receive port 52 of a transmit-receive switch 54, a bidirectional RF port 56 of which is coupled to an antenna 60. Transmit-receive switch 54 has a transmit port 62 thereof coupled to the output of an RF power amplifier 64, that is powered up only during the relatively infrequent transmit mode of operation of the tag, as will be described.

The output of the "slow" pseudo random pulse generator 42 is a series of relatively low repetition rate (for example, from tens of seconds to several hours) randomly occurring pulses or "blinks" that are coupled to a high speed PN spreading sequence generator 73 via an OR gate 75. These blinks/pulses define when the tag will randomly transmit or "blink" bursts of wideband (spread spectrum) RF energy to be detected by the system readers, in order to locate and identify the tag using time-of-arrival geometry processing of the identified first-to-arrive signals, as described above.

In response to an enabling "blink" pulse, the high speed PN spreading sequence generator 73 generates a prescribed spreading sequence of PN chips. The PN spreading sequence generator 73 is driven at the RF frequency output of a crystal oscillator 82. This crystal oscillator provides a reference frequency for a phase locked loop (PLL) 84, which establishes a prescribed output frequency (for example a frequency of 2.4 GHz, to comply with FCC licensing rules). The RF output of the PLL 84 is coupled to a first input 91 of a mixer 93, the output 94 of which is coupled to the RF power amplifier 64.

Mixer 93 has a second input 95 coupled to the output 101 of a spreading sequence modulation exclusive-OR gate 103. A first input 105 of exclusive-OR gate 101 is coupled to receive the PN spreading chip sequence generated by PN generator 73. A second input 107 of OR gate 101 is coupled to receive the respective bits of data stored in a tag data storage memory 110, which are clocked out by the PN spreading sequence generator 73.

As a non-limiting example, the tag memory 110 may comprise a relatively low power, electrically alterable CMOS memory circuit, which serves to store a multibit word or code representative of the identification of the tag. Memory circuit 110 may also store additional parameter data, such as that provided by an associated sensor (e.g., a temperature sensor) 108 that is installed on or external to the tag, and coupled thereto by way of a data select logic circuit 109. The data select logic circuit 109 is further coupled to receive data that is transmitted to the tag by means of an interrogation message from an interrogating unit, as decoded by a command and data decoder 112, which is coupled in circuit with the output of crystal video receiver 50.

The data select logic circuit 109 is preferably implemented in gate array logic and is operative to append any data received from a wand query or an external sensor to that already stored in memory 110. In addition, it may selectively couple sensor data to memory, so that the tag will send only previously stored data. It may also selectively filter or modify data output by the command and data decoder 112, as received from an interrogating wand.

When a query transmission from an interrogation wand 30 is detected, the tag's identification code stored in memory 110 is coupled to a 'wake-up' comparator 114. Comparator 114 compares the tag identification bit contents of a received interrogation message with the stored tag identification code. If the two codes match, indicating receipt of a wand query message to that particular tag, comparator 114 generates an output signal. This output signal is used to cause any data contained in a query message to be decoded by command and data decoder 112, and written into the tag memory 110 via data select logic circuit 109. The output of comparator 114 is coupled through OR gate 75 to the enable input of PN generator 73, so that the tag's transmitter will generate a response RF burst, in the same manner as it randomly and repeatedly 'blinks' a PN spreading sequence transmission containing its identification code and any parameter data stored in memory 110, as described above.

The tag transmitter as mounted to the tag support member 32 as described above typically can comply with ANSI 371.1 RTLS standard and can use a globally accepted 2.4 GHz frequency band, transmitting spread spectrum signals in accordance with the standard. The use of the spread spectrum technology can provide long-range communications in excess of 100 meters for read and a 300 meter locate range for outdoors. This can be accomplished with less than two milliwatts of power. Battery life can be as long as seven years depending upon the blink rate, which could be user configurable from as little as five seconds to as much as one hour. Any type of activation from an interrogator can be up to six meters. The power could be a battery such as an AA lithium thionyl chloride cell. In one aspect, the height is about 0.9 inches and a length of about 2.6 inches or with mounting tags such as used for mounting the tag transmitter on the tag support member about four inches. The width is about 1.7 to about 2 inches.

Figure 6:
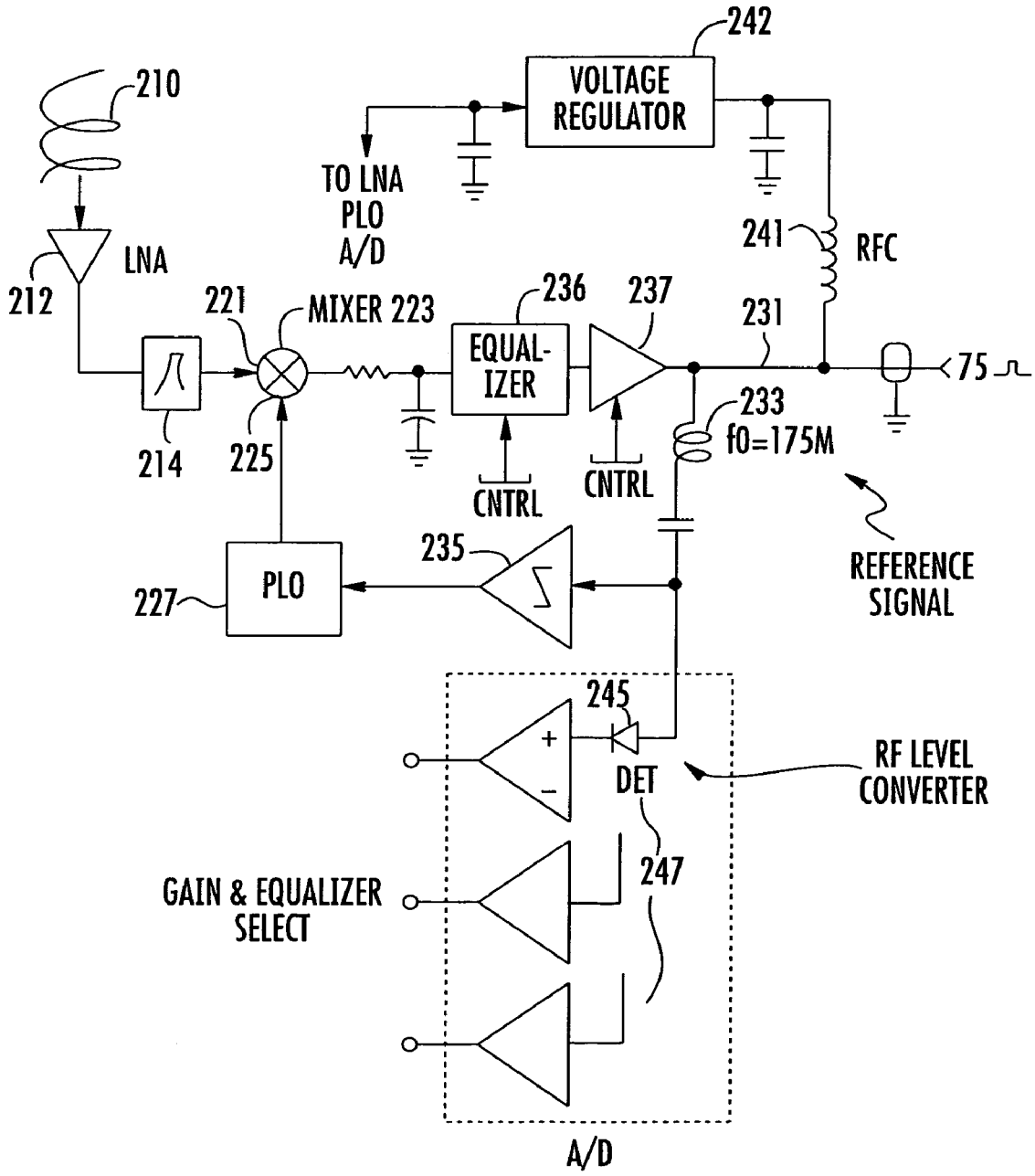
FIG. 6 is a high level schematic circuit diagram showing basic components of an example of the circuit architecture that can be used for a receiver or access points operative with the tag such as shown in FIG. 5B.
Figure 7:
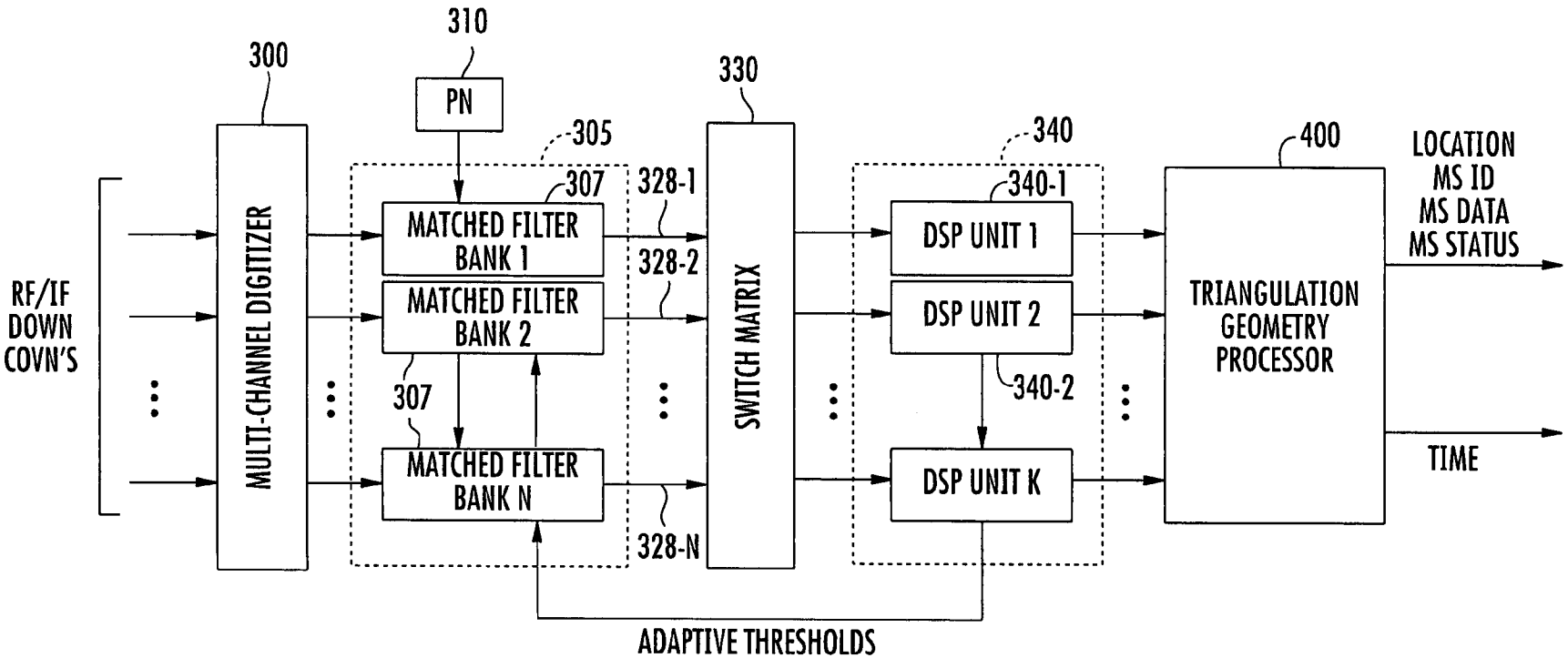
FIG. 7 is a schematic circuit diagram of an example of a circuit architecture that can be used for correlation-based, RF signal location processor operative with the locating receiver as an access point and tag transmitter shown in FIGS. 5B and 6.

FIGS. 6 and 7 represent examples of the type of circuits that can be used with modifications as suggested by those skilled in the art for receiver circuitry as an access point and location processor circuitry as part of a server or separate unit to determine any timing matters, set up a correlation algorithm responsive to any timing matters, determine which tag signals are first-to-arrive signals and conduct differentiation of first-to-arrive signals to locate a tag or other transmitter generating a tag or comparable signal.

Referring now to FIGS. 6 and 7, a representative circuit and algorithm as described in the above mentioned and incorporated by reference patents are disclosed and set forth in the description below to aid in understanding the type of receiver or access point and location processor circuitry that can be used for determining which signals are first-to-arrive signals and how a processor conducts differentiation of the first-to-arrive signals to locate a tag transmitter.

FIG. 6 diagrammatically illustrates one type of circuitry configuration of a respective architecture for "reading" associated signals or a pulse (a "blink") used for location determination signals, such as signals emitted from a tag transmitter to a receiver as a locating access point. An antenna 210 senses appended transmission bursts or other signals from the object and tag transmitter to be located. The antenna in this aspect of the invention could be omnidirectional and circularly polarized, and coupled to a power amplifier 212, whose output is filtered by a bandpass filter 214. Naturally, dual diversity antennae could be used or a single antenna. Respective I and Q channels of a bandpass filtered signal are processed in associated circuits corresponding to that coupled downstream of filter 214. To simplify the drawing only a single channel is shown.

A respective bandpass filtered I/Q channel is applied to a first input 221 of a down-converting mixer 223. Mixer 223 has a second input 225 coupled to receive the output of a phase-locked local IF oscillator 227. IF oscillator 227 is driven by a highly stable reference frequency signal (e.g., 175 MHz) coupled over a (75 ohm) communication cable 231 from a control processor. The reference frequency applied to phase-locked oscillator 227 is coupled through an LC filter 233 and limited via limiter 235.

The IF output of mixer 223, which may be on the order of 70 MHz, is coupled to a controlled equalizer 236, the output of which is applied through a controlled current amplifier 237 and preferably applied to communication cable 231 through a communication signal processor, which could be an associated processor. The communication cable 231 also supplies DC power for the various components of the access point by way of an RF choke 241 to a voltage regulator 242, which supplies the requisite DC voltage for powering an oscillator, power amplifier and analog-to-digital units of the receiver.

A 175 MHz reference frequency can be supplied by a communications control processor to the phase locked local oscillator 227 and its amplitude could imply the length of any communication cable 231 (if used). This magnitude information can be used as control inputs to equalizer 236 and current amplifier 237, so as to set gain and/or a desired value of equalization, that may be required to accommodate any length of any communication cables (if used). For this purpose, the magnitude of the reference frequency may be detected by a simple diode detector 245 and applied to respective inputs of a set of gain and equalization comparators shown at 247. The outputs of comparators are quantized to set the gain and/or equalization parameters.

It is possible that sometimes signals could be generated through the clocks used with the global positioning system receivers and/or other wireless signals. Such timing reference signals can be used as suggested by known skilled in the art.

FIG. 7 diagrammatically illustrates the architecture of a correlation-based, RF signal processor circuit as part of a location processor to which the output of a respective RF/IF conversion circuit of FIG. 6 can be coupled such as by wireless communication (or wired in some instances) for processing the output and determining location based on the GPS receiver location information for various tag signal readers. The correlation-based RF signal processor correlates spread spectrum signals detected by an associated tag signal reader with successively delayed or offset in time (by a fraction of a chip) spread spectrum reference signal patterns, and determines which spread spectrum signal is the first-to-arrive corresponding to a location pulse.

Because each access point can be expected to receive multiple signals from the tag transmitter due to multipath effects caused by the signal transmitted by the tag transmitter being reflected off various objects/surfaces, the correlation scheme ensures identification of the first observable transmission, which is the only signal containing valid timing information from which a true determination can be made of the distance.

For this purpose, as shown in FIG. 7, the RF processor employs a front end, multichannel digitizer 300, such as a quadrature IF-baseband down-converter for each of an N number of receivers. The quadrature baseband signals are digitized by associated analog-to-digital converters (ADCs) 272I and 272Q. Digitizing (sampling) the outputs at baseband serves to minimize the sampling rate required for an individual channel, while also allowing a matched filter section 305, to which the respective channels (reader outputs) of the digitizer 300 are coupled to be implemented as a single, dedicated functionality ASIC, that is readily cascadable with other identical components to maximize performance and minimize cost.

This provides an advantage over bandpass filtering schemes, which require either higher sampling rates or more expensive analog-to-digital converters that are capable of directly sampling very high IF frequencies and large bandwidths. Implementing a bandpass filtering approach typically requires a second ASIC to provide an interface between the analog-to-digital converters and the correlators. In addition, baseband sampling requires only half the sampling rate per channel of bandpass filtering schemes.

The matched filter section 305 may contain a plurality of matched filter banks 307, each of which is comprised of a set of parallel correlators, such as described in the above identified, incorporated by reference '926 patent. A PN spreading code generator could produce a PN spreading code (identical to that produced by a PN spreading sequence generator of a tag transmitter). The PN spreading code produced by PN code generator is supplied to a first correlator unit and a series of delay units, outputs of which are coupled to respective ones of the remaining correlators. Each delay unit provides a delay equivalent to one-half a chip. Further details of the parallel correlation are found in the incorporated by reference '926 patent.

As a non-limiting example, the matched filter correlators may be sized and clocked to provide on the order of $4\times10^6$ correlations per epoch. By continuously correlating all possible phases of the PN spreading code with an incoming signal, the correlation processing architecture effectively functions as a matched filter, continuously looking for a match between the reference spreading code sequence and the contents of the incoming signal. Each correlation output port 328 is compared with a prescribed threshold that is adaptively established by a set of "on-demand" or "as needed" digital processing units 340-1, 340-2, . . . 340-K. One of the correlator outputs 328 has a summation value exceeding the threshold in which the delayed version of the PN spreading sequence is effectively aligned (to within half a chip time) with the incoming signal.

This signal is applied to a switching matrix 330, which is operative to couple a "snapshot" of the data on the selected channel to a selected digital signal processing unit 340-1 of the set of digital signal processing units 340. The units can "blink" or transmit location pulses randomly, and can be statistically quantified, and thus, the number of potential simultaneous signals over a processor revisit time could determine the number of such "on-demand" digital signal processors required.

A processor would scan the raw data supplied to the matched filter and the initial time tag. The raw data is scanned at fractions of a chip rate using a separate matched filter as a co-processor to produce an auto-correlation in both the forward (in time) and backwards (in time) directions around the initial detection output for both the earliest (first observable path) detection and other buried signals. The output of the digital processor is the first path detection time, threshold information, and the amount of energy in the signal produced at each receiver's input, which is supplied to and processed by the time-of-arrival-based multi-lateration processor section 400.

Processor section 400 could use a standard multi-lateration algorithm that relies upon time-of-arrival inputs from at least three readers to compute the location of the tag transmitter. The algorithm may be one which uses a weighted average of the received signals. In addition to using the first observable signals to determine object location, the processor also can read any data read out of a memory for the tag transmitter and superimposed on the transmission. Object position and parameter data can be downloaded to a database where object information is maintained. Any data stored in a tag memory may be augmented by altimetry data supplied from a relatively inexpensive, commercially available altimeter circuit. Further details of such circuit are found in the incorporated by reference '926 patent.

It is also possible to use an enhanced circuit as shown in the incorporated by reference '926 patent to reduce multipath effects, by using dual antennae and providing spatial diversity-based mitigation of multipath signals. In such systems, the antennas are spaced apart from one another by a distance that is sufficient to minimize destructive multipath interference at both antennas simultaneously, and also ensure that the antennas are close enough to one another so as to not significantly affect the calculation of the location of the object by a downstream multi-lateration processor.

The multi-lateration algorithm executed by the location processor 26 could be modified to include a front end subroutine that selects the earlier-to-arrive outputs of each of the detectors as the value to be employed in a multi-lateration algorithm. A plurality of auxiliary "phased array" signal processing paths can be coupled to the antenna set (e.g., pair), in addition to any paths containing directly connected receivers and their associated first arrival detectors that feed the locator processor. Each respective auxiliary phased array path is configured to sum the energy received from the two antennas in a prescribed phase relationship, with the energy sum being coupled to associated units that feed a processor as a triangulation processor.

The purpose of a phased array modification is to address the situation in a multipath environment where a relatively "early" signal may be canceled by an equal and opposite signal arriving from a different direction. It is also possible to take advantage of an array factor of a plurality of antennas to provide a reasonable probability of effectively ignoring the destructively interfering energy. A phased array provides each site with the ability to differentiate between received signals, by using the "pattern" or spatial distribution of gain to receive one incoming signal and ignore the other.

The multi-lateration algorithm executed by the location processor 26 could include a front end subroutine that selects the earliest-to-arrive output of its input signal processing paths and those from each of the signal processing paths as the value to be employed in the multi-lateration algorithm (for that receiver site). The number of elements and paths, and the gain and the phase shift values (weighting coefficients) may vary depending upon the application.

It is also possible to partition and distribute the processing load by using a distributed data processing architecture as described in the incorporated by reference '976 patent. This architecture can be configured to distribute the workload over a plurality of interconnected information handling and processing subsystems. Distributing the processing load enables fault tolerance through dynamic reallocation.

The front end processing subsystem can be partitioned into a plurality of detection processors, so that data processing operations are distributed among sets of processors. The partitioned processors are coupled in turn through distributed association processors to multiple location processors. For tag detection capability, each reader could be equipped with a low cost omnidirectional antenna, that provides hemispherical coverage within the monitored environment.

A detection processor filters received energy to determine the earliest time-of-arrival energy received for a transmission, and thereby minimize multi-path effects on the eventually determined location of a tag transmitter. The detection processor demodulates and time stamps all received energy that is correlated to known spreading codes of the transmission, so as to associate a received location pulse with only one tag transmitter. It then assembles this information into a message packet and transmits the packet as a detection report over a communication framework to one of the partitioned set of association processors, and then de-allocates the detection report.

A detection processor to association control processor flow control mechanism equitably distributes the computational load among the available association processors, while assuring that all receptions of a single location pulse transmission, whether they come from one or multiple detection processors, are directed to the same association processor.

Figure 8:
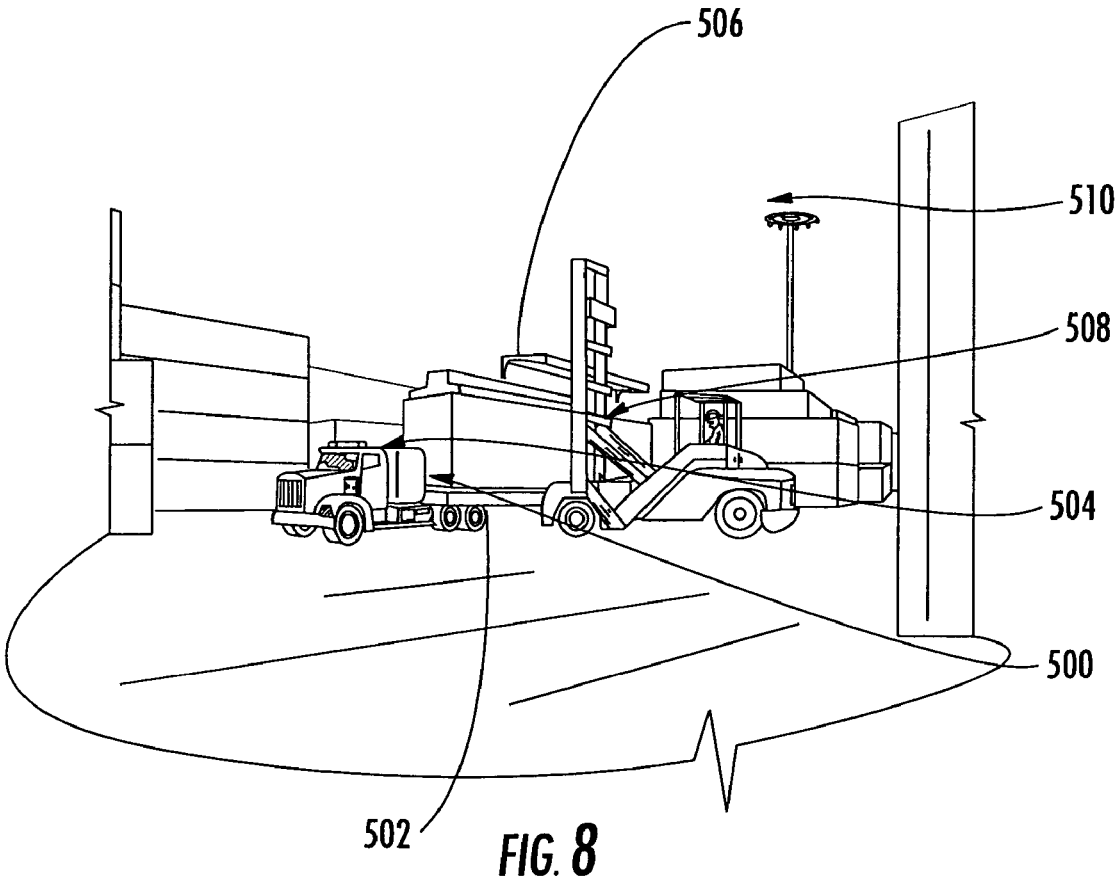
FIG. 8 is an environmental view of a top pick, drayman tractor and chassis with the top pick unloading a shipping container, wherein the trailer and shipping container could both have a temporary tag mounting device and tag transmitter mounted thereto.

FIG. 8 shows a shipping container 500 arriving into the yard on a tractor trailer 502 that is off-loaded by a "top pick" (e.g., often referred to as a "top pick spreader") loader and stacked on the "ground" so that an outside drayman can take the chassis as it leaves. This shipping container 500 may be stored for only a few hours and it may be desirable to temporarily track this container. The tag mounting device 10 would be applied by a person pulling on the lever and securing the tongue member into the rim. If a rim is not conveniently located for temporarily mounting the tag mounting device, then the container insert can be removably mounted on the support leg and inserted into a cavity or opening of a container using the lever pole to secure the tag mounting device on the container.

For purpose of description, a drayage tractor 504 is illustrated and the top pick is illustrated at 506 within a horizontal top pick spreader 508 for grabbing shipping containers. An antenna mast 510 could support an access point.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A system for tracking a shipping container or a trailer within a monitored environment, comprising:

a tag mounting device adapted to be temporarily mounted to a container or trailer within the monitored environment, said tag mounting device comprising a mounting frame having a support leg with opposing ends, a clamp mechanism comprising a latch member carried by an end of the support leg and comprising a tongue member for extending into a rim on the container and lever carried by the latch member and adapted for clamping the support leg onto a rim of the container or trailer such that the support leg extends against a surface of the container or trailer, a tag support member extending outward from the other end of the support leg opposing the clamp mechanism, and a tag transmitter carried by the tag support member and operative for transmitting wireless signals;

at least one receiver positioned at a known location within the monitored environment that receives the wireless signals from the tag transmitter; and a processor in communication with the at least one receiver for locating the tag transmitter and determining the location of the shipping container or trailer.

2. A system according to claim 1, wherein said mounting frame is substantially L-shaped, and said tag support member extends transverse from said support leg.

3. A system according to claim 1, wherein said latch member comprises a biasing member for biasing the support leg against a surface of the container or trailer when the tongue member engages the rim of the container or trailer.

4. A system according to claim 1, and further comprising a container insert removably mounted on the support leg and sized to be inserted into an opening on a container and securing the tag mounting device on the container with the support leg engaging a surface of the container.

5. A system according to claim 4, wherein said container insert is sized to space the clamp mechanism from a surface of the container such that the container insert supports the tag mounting device on the container.

6. A system according to claim 4, wherein said container insert tapers from the support leg outward to facilitate insertion of the container insert within an opening of the container.

7. A system according to claim 1, wherein said location processor is operative for correlating a wireless signal as a first-to-arrive signal and conducting differentiation of first-to-arrive signals for locating the tag transmitter.

8. A system according to claim 1, wherein said wireless signals comprise spread spectrum wireless RF signals.

9. A tag mounting device adapted for temporarily mounting a tag transmitter on a shipping container or trailer for tracking location of a shipping container or trailer, comprising:

a mounting frame having a support leg with opposing ends;

a clamp mechanism comprising a latch member carried by the support leg at one end and comprising a tongue member for extending into a rim on the container and a lever carried by the latch member for clamping the support leg onto a rim of a container or trailer such that the support leg extends against a surface of a container or trailer;

a tag support member extending outward from the other end of the support leg opposite the clamp mechanism; and a tag transmitter carried by the tag support member and operative for transmitting wireless signals.

10. A tag mounting device according to claim 9, wherein said mounting frame is substantially L-shaped and said tag support member extends transverse from said support leg.

11. A tag mounting device according to claim 9, wherein said latch member comprises a biasing member for biasing the support leg against a surface of a container or trailer when the tongue member engages the rim of a container or trailer.

12. A tag mounting device according to claim 9, and further comprising a container insert removably mounted on the support leg and sized to be inserted into an opening of a container and securing the mounting frame on a container with the support leg engaging a surface of a container.

13. A tag mounting device according to claim 12, wherein said container insert is sized to space the clamp mechanism from a surface of a container such that the container insert supports the mounting frame on a container.

14. A tag mounting device according to claim 12, wherein said container insert tapers from the support leg outward to facilitate insertion of the container insert within an opening of a container.

15. A tag mounting device according to claim 9, wherein said wireless RF signals comprise spread spectrum wireless RF signals.

16. A method for tracking a shipping container or a trailer within a monitored environment comprising:

temporarily mounting a tag mounting device on a container or trailer by clamping a support leg of a mounting frame forming the tag mounting device onto a rim of the container or trailer such that the support leg extends against a surface of the container or trailer, wherein a tag support member extends outward from the support leg and carries a tag transmitter that transmits wireless signals;

receiving the wireless signals emitted from the tag transmitter within at least one receiver positioned at a known location within the monitored environment;

locating the tag transmitter and determining the location of the cargo container or trailer to which the tag mounting device is temporarily mounted; and removably mounting a container insert on the support leg and inserting the container insert within a cavity on a container for securing the tag mounting device to the container.

17. A method according to claim 16, which further comprises pivoting a latch member for extending a tongue member into the rim of the cargo container or trailer.

18. A system for tracking a shipping container or a trailer within a monitored environment, comprising:

a tag mounting device adapted to be temporarily mounted to a container or trailer within the monitored environment, said tag mounting device comprising a mounting frame having a support leg with opposing ends, a clamp mechanism carried by an end of the support leg and adapted for clamping the support leg onto a rim of the container or trailer such that the support leg extends against a surface of the container or trailer, a tag support member extending outward from the other end of the support leg opposing the clamp mechanism, and a tag transmitter carried by the tag support member and operative for transmitting wireless signals;

at least one receiver positioned at a known location within the monitored environment that receives the wireless signals from the tag transmitter; and a processor in communication with the at least one receiver for locating the tag transmitter and determining the location of the shipping container or trailer, and further comprising a container insert removably mounted on the support leg and sized to be inserted into an opening on a container and securing the tag mounting device on the container with the support leg engaging a surface of the container.

19. A system according to claim 18, wherein said container insert is sized to space the clamp mechanism from a surface of the container such that the container insert supports the tag mounting device on the container.

20. A system according to claim 18, wherein said container insert tapers from the support leg outward to facilitate insertion of the container insert within an opening of the container.

* * * * *